United States Patent [19]

Lemelson

[11] Patent Number: 4,699,052

[45] Date of Patent: Oct. 13, 1987

[54] ELECTRONICALLY CONTROLLED PRINTING DEVICE

[76] Inventor: Jerome H. Lemelson, 85 Rector St., Metuchen, N.J. 08840

[21] Appl. No.: 118,195

[22] Filed: Feb. 4, 1980

[51] Int. Cl.[4] ..... B41J 3/20

[52] U.S. Cl. ..... 101/110; 101/93.18

[58] Field of Search ..... 101/110; 400/93.18, 400/88

[56] References Cited

U.S. PATENT DOCUMENTS

| | | | |
|---|---|---|---|
| 3,504,622 | 4/1970 | Morrison | 101/110 X |
| 3,940,758 | 2/1976 | Margolin | 400/88 X |
| 4,253,774 | 3/1981 | Hanakata et al. | 400/88 X |

*Primary Examiner*—Edward M. Coven

[57] ABSTRACT

A printing device for printing characters and codes on surfaces. In one form, the device is contained within a hand-held housing of rectangular parallelepiped configuration having an opening in one of the major surfaces thereof through which opening printing material may be dispensed to form characters or codes against the surface of an article which is adjacent to the opening. A plurality of printing wheels may be employed on a common shaft with each wheel selectively rotated to bring a particular character on the periphery of the wheel into alignment with the opening in the housing after which all of the wheels are simultaneously projected through the opening to engage the surface to receive the printing. In another form, printing material is sprayed or otherwise propelled through the opening in the configurations of characters or code marks to be dispensed against the surface to be printed. A keyboard is provided against or within the confines of the surface of the housing which is opposite that containing the opening and the selective manipulation of the keys thereof controls the printing means to operate and print the selected characters through the opening. Visual alignment means in the form of marks or housing configurations is provided to align the opening in the housing with a selected portion of a surface to receive the printing.

13 Claims, 5 Drawing Figures

ELECTRONICALLY CONTROLLED PRINTING DEVICE

SUMMARY OF THE INVENTION

This invention relates to an apparatus for printing characters on surfaces by means of a hand-held unit containing electrically operated and controlled printing means. Computing means defined by micro-miniature electrical circuitry provided within the unit receives signals generated by selectively operating keys of a keyboard to control the printing operation.

There is need for a manually operated printing device which is light in weight, portable and preferably capable of being held in the hand and carried on a person, for printing characters or codes on the surfaces of articles or containers for articles. Such a device may be utilized to code, price and identify a variety of products and articles such as equipment, to print labels and receipts. The instant invention is drawn to a device which not only fulfills such requirements but which also may be easily varied in its operation so as to permit the printing of different codes and characters against the surfaces of a variety of different articles and to enter characters or codes along selected lines of record sheets.

Accordingly, it is a primary object of this invention to provide a new and improved printing apparatus for printing lines of characters and codes against surfaces.

Another object is to provide a portable printing device which may be easily held in the hand and may be utilized to print lines of characters and codes against selected portions of surfaces of articles and documents.

Another object is to provide a portable printing device which may be easily manipulated by hand and aligned with a selected portion of a document such as a record sheet and operated in a manner to print a line of characters in alignment with other characters printed thereon.

Another object is to provide a hand held calculating device which may be easily manipulated and operated to perform mathematical computations and to print the results of such computations against surfaces such as the surface of a document, record or tabulation sheet.

Another object is to provide a hand held calculating and printing device which may be operated to print consecutive numbers against a surface or different surfaces for record keeping or inventory purposes and may also be utilized to easily print any selected number or code defined by the operation of keys thereof.

Another object is to provide a hand held printing device containing key operated means for predetermining the characters to be printed and a display viewable to the operator of the keyboard and operable for displaying representations of the characters or code printed or about to be printed.

Another object is to provide a manually positioned and operated electronic printing device which is light in weight and easy to manipulate and position with respect to surfaces on which printing is to be provided thereby wherein the printing may be easily programmed and varied by the operator thereof.

Another object is to provide a printing device which may be employed to print both characters and bar codes on surfaces.

Another object is to provide a hand held and positioned printing device employing electronic circuit means for both controlling a selected printing operation and displaying selected characters to be printed before they are applied to a surface.

Another object is to provide a hand held printing device which employs ink jet means for printing characters in surfaces which ink jet printing means is controlled by microminiature circuit means located within the printer housing.

With the above and such other objects in view as may hereinafter more fully appear, the invention consists of the novel constructions, combinations and arrangements of parts as will be more fully described and illustrated in the accompanying drawings, but it is to be understood that changes, variations and modifications may be resorted to which fall within the scope of the invention as claimed.

In the drawings:

FIG. 2 is a schematic diagram of electronic circuitry employed to operate a printing device of the type shown in FIGS. 1 and 1A and the like.

FIG. 5 is an isometric view of yet another modified form of the printing device of FIGS. 1 and 1A employing a printing matrix as a replacement for the printing wheels thereof.

Figure 1:
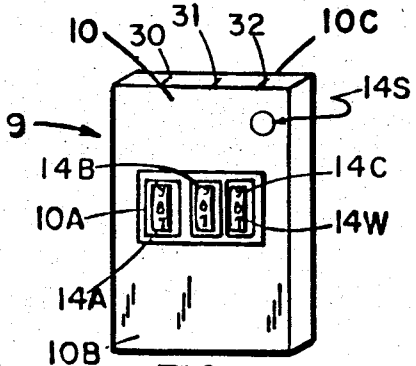
FIG. 1 is an isometric view of the working face of one form of manually held and programmed printing device within the purview of the invention.
Figure 1A:
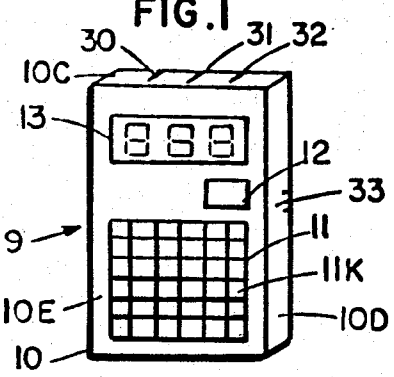
FIG. 1A is an isometric view of the rear side of the device of FIG. 1 which faces the operator thereof during the printing operation.

FIG. 1 and 1A illustrate a portable, manually operable hand-held alpha-numeric printing device 9 defined by a box-shaped housing 10 which contains or supports a keyboard 11 having an array of input keys 11K containing letter and/or numerical notations and, as the need may be, special keys and symbols which may be necessary for particular printing applications. The keys 11K are supported by housing 10 or the frame of the keyboard 11 and include a print activating key 12 which is adapted to be actuated when all the information to be printed has been entered and the housing 10 is properly located with respect to the surface of an article or work to be printed on. A display or readout 13 is also provided, supported by housing 10 and viewable from the keyboard side thereof to display the information entered by means of selectively depressing the keys 11K of the keyboard 11.

In FIG. 1, an isometric view which shows the side of the housing 10 adapted to be placed against the surface to receive the printed characters or code, there is shown an appropriate opening 10A in a wall 10B of the housing, through which opening a bank 14 of selectively rotatable print wheels 14W may be driven by a motor or solenoid in response to the activation of the print key 12 to thereby effect printing the selected information on the surface of the article against which the rear wall 10E is engaged.

Figure 2:
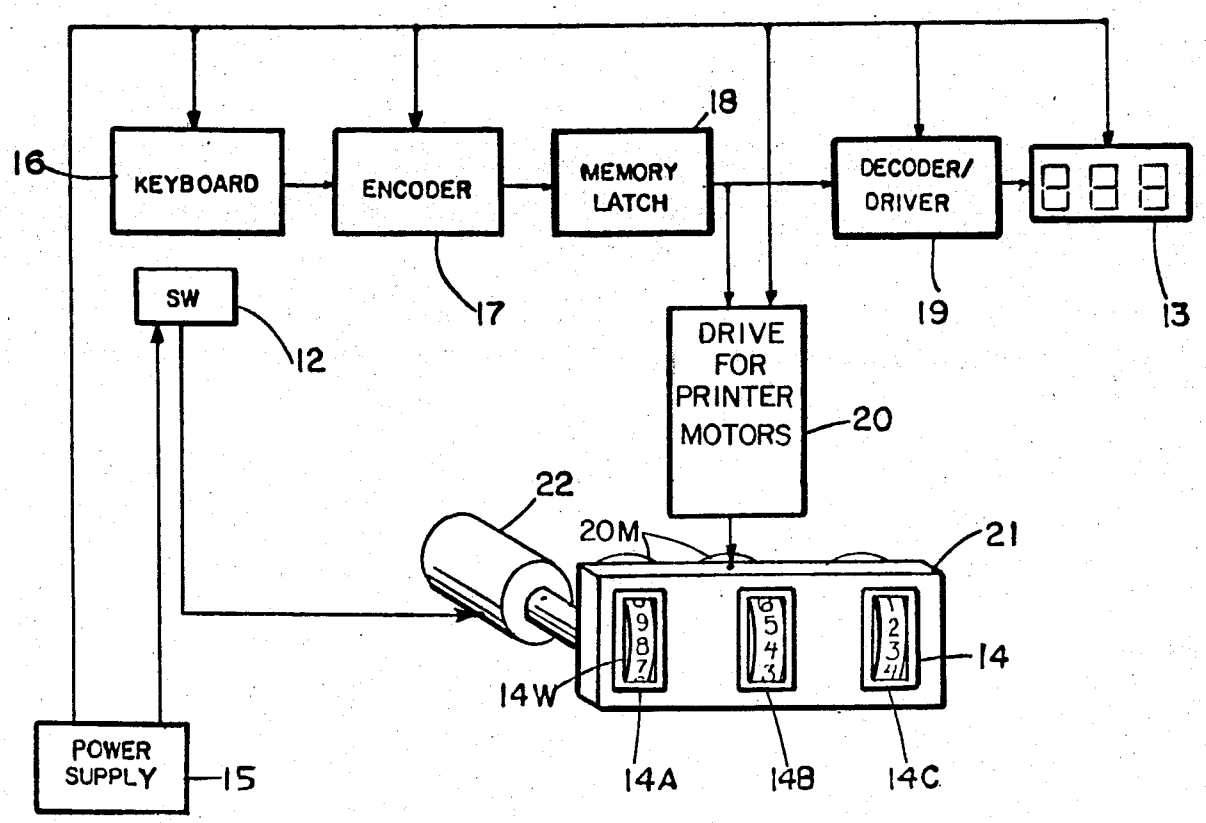

The print wheels 14W are preferably supported on a common shaft or shafts and may be step-driven by respective stepping motors or solenoids 20M supported within housing 10 and operable to be pulsed in their operation by signals received from drive circuits 20 as illustrated in FIG. 2. The bank 14 of printing wheels 14W may be constructed in accordance with conventional multiple-wheel or drum printing arrangements which are motor operated and may be controlled by generating suitable electrical control signals to present selected alphabetical or numerical characters at the printing positions of the wheels by properly rotating each wheel from a starting or home position. Such home position may be attained by means of a conventional mechanical reset push button operated mechanism 14S or by the automatic operation of the motors 20M driving the print wheels when a reset switch (not shown) is manually operated on the housing.

Notations 30, 31 and 32 refer to alignment marks or indicia printed, embossed or molded in the upper end wall 10C of housing 10 for visually noting the lateral locations of the characters or indicia defined by the lateral locations of the printing devices or wheels 14W while notation 33 refers to the axial or horizontal locations of the line of characters to be printed as defined by a mark, notch or embossing in the side wall 10D of housing 10.

While but three print wheels 14A, 14B and 14C are shown in the embodiment of the invention illustrated in FIGS. 1 and 2, any number of such wheels in one or more rows thereof may be provided to provide additional character locations for printing one or more lines of such characters on a surface. The wheels may be provided with alphabetical as well as numerical characters and may also contain other indicia such as bar code components to be printed in accordance with the selected operation of the keys 11K of the keyboard and/or other switches (not shown) or another programming means such as a strip or card containing information to be printed which card or strip may be read by suitable reading means located in the housing 10 or remote therefrom.

Other means for sighting and aligning the print locations of housing 10 may also be provided such as one or more windows in the front and rear walls of the housing or optical components such as prisms and/or lenses for providing an image of the surface to be printed on, on a screen supported by the front wall 10B of housing wherein a light source provided within said housing may direct light against the surface to receive the printing and to project such image on such screen.

FIG. 2 shows electronic circuits and controls which may be employed for the proper operation of hand held printing device 9 to effect the selective printing of codes or characters on the surface of an article disposed in alignment with the opening 10A in the housing. A suitable source of electrical energy such as a battery 15 is provided within the housing 10 and is connected to all active circuits for controlling the printer as described hereafter. The keys of keyboard 11 are selectively activated by the user of the printing device 9 and an encoder circuit 17 converts the keyboard generated signals to appropriate digital codes, such as so called binary decimal codes or B.C.D. codes, and presents such code signals to a calculator 18C and a memory 18 in which memory the code is held in storage, such as in integrated circuit resistance or solid state relay storage, until printing is effected. A decoder-driver circuit 19 converts the codes and power levels of the memory latch output to appropriate signals for activating the readout 13. Such readout may be formed of light emitting diodes (LED), liquid crystal displays (LCD), or other suitable means which display the entered information.

The output of memory latch 18 is also connected to printer-drive circuits 20 which control a motor or solenoid or a number of same to determine the proper position of the print wheels, denoted 14A–14C, which are rotatably supported on the printer assembly 21 as determined by the information held in the memory bank or latch 18. Printer drive circuits 20 may also contain suitable drive means for the motor or motors rotating the print wheels 14A–14C.

When the entry of information to be printed has been completed by the selective operation of the keys of keyboard 11 and the printer has been properly oriented and disposed with respect to the article to receive the printing thereof, the print key 12, which may comprise a normally open switch, is activated by the operator of the device and closure thereof energizes a monostable solenoid 22 which advances the printer assembly 21 to cause the forward portions of the printing wheels to simultaneously contact the surface of the article or work with sufficient force so that the inked cuts of the wheels engaging the work print the information determined by the characteristics of the printing wheels facing outwardly, on the article or surface against which the wall 12R of the housing is engaged or disposed.

While the embodiment of the invention illustrated in FIGS. 1, 1A and 2 of the drawings employs a bank of printing wheels which are selectively controlled in rotation to bring the character defining cuts thereof into alignment with a printing position and employ ink applied to the wheel mounted characters either through the cuts or from an inking roller supported within the housing 10 or the housing containing the printing wheels, other means programmed or controlled by the signals generated by the keyboard and presented to the memory 18 may also be employed to effect the printing of selected characters or code bars on a surface disposed in alignment with the opening 10A in the housing. Two of such other printing means are illustrated in FIGS. 3 and 4.

Figure 3:
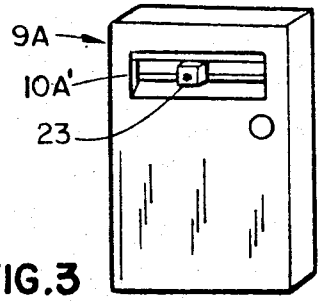
FIG. 3 is a schematic diagram of the electronic circuits and controls for operating the device of FIGS. 1 and 2 during selected printing operations.

In FIG. 3 is shown a hand holdable printing device 9A provided in a housing similar in shape to the housing of the embodiment of FIGS. 1 and 1A and having an opening 10A' similar to the opening 10A of the housing of FIG. 1. A printing head 23 is supported behind the opening 10A' and may comprise an nozzle of the conventional type used in ink-jet printers to print a line of characters on a print receiving surface of an article aligned across the opening as the nozzle is driven laterally through the housing across such opening therein. Such ink jet printing may be be effected as described above when print control signals are reproduced from a memory and are applied to control the operation of the ink jet printer.

In yet another embodiment, the printing head 23 may comprise a radiation beam generating device, such as a laser or may contain a plurality of lasers which are operable, when controlled by suitable print-control signals, to be deflection controlled and pulsed in a manner to scribe or discolor the surface of the work aligned with the opening 10A'. The laser or lasers may be operable to generate dot matrix recordings by discoloring or burning holes in the record member or work.

Figure 4:
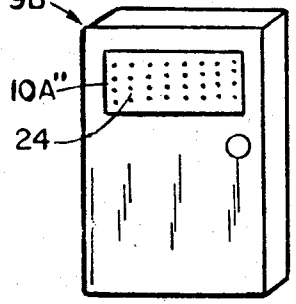
FIG. 4 is an isometric view of a modified form of the hand held printing device of FIGS. 1 and 1A employing an ink jet printing means as a replacement for the printing wheels thereof.

In FIG. 4 is shown another form of the invention comprising a hand holdable printing device 9A having a box shaped housing with a rectangular opening 10A" similar in shape to the opening 10A of the device 9 of FIGS. 1 and 1A and containing a plurality of dot matrix printing electrodes 24 disposed within such opening and operable, when selectively energized, to form matrix recordings on the surface of a thermally responsive or sensitive surface against which the wall of the housing containing the opening is disposed.

I claim:

1. A printing device comprising:

a housing having an opening in a wall thereof and capable of being hand positioned to dispose said opening in alignment with a selected portion of a surface to be printed on, printing means disposed within said housing including means operable through said opening for forming a plurality of indicia on a surface aligned with said opening, key operated switching means supported by a wall of said housing, control means supported within said housing and operatively connected to said key operated switching means and said printing means for causing said printing means to print selected indicia on a surface aligned with said opening in response to the selective operation of the keys of said key operated switching means, and switch means supported by said housing for activating said printing means and causing indicia to be printed on said surface.

2. A printing device in accordance with claim 1 including calculating means operatively connected to receive input information generated by the selective operation of said key operated switching means and operatively connected to control the operation of said printing means in accordance with calculations performed thereby.

3. A printing device in accordance with claim 1 wherein said printing means comprises a plurality of separate printing wheels each containing a plurality of characters and motor means for selectively rotating said printing wheels to bring selected characters of each into alignment with said opening.

4. A printing device in accordance with claim 3 including means for simultaneously moving said printing wheels through said opening to bring a selected portion of each wheel into engagement with a surface aligned with said opening for effecting the printing of the characters defined by the selected portions of the wheels engaging the surface aligned with the opening.

5. A printing device in accordance with claim 1 wherein said printing means comprises a printing matrix aligned with said opening and selectively operable to generate different characters and means for effecting the printing of the characters generated by said matrix on a surface aligned with said opening.

6. A printing device in accordance with claim 1 wherein said printing means comprises an ink jet generating and depositing means operable for flowing particles of ink through said opening in patterns which define said indicia upon becoming deposited on a surface aligned with said opening.

7. An apparatus in accordance with claim 1 wherein said printing means comprises laser means operable to generate and direct intense light energy through said opening in said wall of said housing in a pattern which is representative of the indicia to be formed on the surface aligned with said opening and means for causing the pattern of light generated by said laser means to form said indicia.

8. A device in accordance with claim 7 including means for generating said laser light energy at sufficient intensity to thermally heat and discolor the surface aligned with said opening for forming said indicia thereon.

9. An apparatus in accordance with claim 1 wherein said printing means comprises means for feeding a narrow strip of thermally sensitive material past said opening and means for generating intense radiant energy in the configuration of said indicia and directing said radiant energy against said narrow strip of heat sensitive material in a manner to cause at least a portion of said material to become deposited on to the surface aligned with said opening in the configuration of the selected indicia.

10. A printing device comprising in combination:

a housing having an opening in a wall thereof and capable of being hand positioned to dispose said opening aligned with a select portion of a surface to be printed on, printing means disposed within said housing and operable through said opening for forming a plurality of indicia on a surface aligned with said opening, printing control means supported by said housing and operable when activated for causing said printing means to print selected indicia on a surface aligned with said opening, electronic circuit means energizable by the operation of said printing control means for generating electrical control signals defining selected information and applying said control signals to control the operation of said printing means to print said selected information in the form of selected indicia on said select portion of said surface aligned with said opening.

11. A printing device in accordance with claim 10 in which said printing means is an ink-jet printer operable to direct a controlled stream of ink particles through said opening and to deposit said particles to form selected indicia on a surface adjacent said opening.

12. A printing device in accordance with claim 11 wherein said ink jet printer includes an ink jet forming and dispensing head fixedly supported within said housing, said ink jet printer being operable to print said indicia in a row laterally across said opening.

13. A printing device in accordance with claim 11 wherein said ink jet printer includes an operating head for forming and dispensing a jet of ink, means for driving and guiding said operating head in a path across said opening in synchronization with the generation of said electrical control signals to permit said signals to control the operation of said jet printer to print selected idicia along a band area of a surface disposed adjacent said opening.

* * * * *